US009685121B2

(12) United States Patent
Jung et al.

(10) Patent No.: US 9,685,121 B2
(45) Date of Patent: Jun. 20, 2017

(54) ELECTROWETTING DISPLAY DEVICE HAVING IMPROVED APERTURE RATIO AND METHOD OF DRIVING THE SAME

(71) Applicant: Samsung Electronics Co., Ltd., Suwon-Si, Gyeonggi-Do (KR)

(72) Inventors: Myoung-hoon Jung, Seoul (KR); Jung Woo Kim, Hwaseong-si (KR); Young-jun Yun, Seongnam-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 420 days.

(21) Appl. No.: 13/920,469

(22) Filed: Jun. 18, 2013

(65) Prior Publication Data

US 2014/0139507 A1 May 22, 2014

(30) Foreign Application Priority Data

Nov. 20, 2012 (KR) ..... 10-2012-0131943

(51) Int. Cl.
*G09G 5/00* (2006.01)
*G09G 3/34* (2006.01)

(52) U.S. Cl.
CPC ..... *G09G 3/348* (2013.01); *G09G 2300/0842* (2013.01); *G09G 2310/0205* (2013.01);
(Continued)

(58) Field of Classification Search
CPC ..... G09G 3/348; G09G 2320/0238; G09G 2380/02; G09G 2310/061; G09G 2310/0205; G09G 2300/0842
See application file for complete search history.

(56) References Cited

U.S. PATENT DOCUMENTS

2008/0224970 A1 9/2008 Van Den Biggelaar et al.
2010/0177026 A1* 7/2010 Van Dijk ..... G02B 3/14 345/84

(Continued)

FOREIGN PATENT DOCUMENTS

JP 2010107908 A 5/2010
KR 20070015193 A 2/2007

(Continued)

*Primary Examiner* — Matthew Sim

(74) *Attorney, Agent, or Firm* — Harness, Dickey & Pierce, P.L.C.

(57) ABSTRACT

An electrowetting display device includes an electrowetting pixel cell and a driving circuit. The electrowetting pixel cell including a polar liquid and a non-polar liquid disposed between a common electrode and a pixel electrode, the pixel electrode configured to receive a fixed voltage and the common electrode configured to receive a variable voltage that varies according to an image signal. The driving circuit configured to control an operation of the electrowetting pixel cell by, providing an image signal to the electrowetting pixel cell at a display interval where the electrowetting pixel cell displays an image, and providing a reset voltage to the electrowetting pixel cell at a reset interval. An absolute value of a difference between the voltage applied to the pixel electrode and the reset voltage is greater than that of a difference between the voltage applied to the pixel electrode and the voltage applied to the common electrode.

18 Claims, 5 Drawing Sheets

(52) U.S. Cl.
CPC ..... *G09G 2310/061* (2013.01); *G09G 2320/0238* (2013.01); *G09G 2380/02* (2013.01)

(56) References Cited

U.S. PATENT DOCUMENTS

| | | | | |
|---|---|---|---|---|
| 2011/0025668 | A1* | 2/2011 | Huitema ..... | G09G 3/348 345/211 |
| 2011/0032276 | A1 | 2/2011 | Chen et al. | |
| 2012/0212470 | A1* | 8/2012 | van Veenendaal ... | G09G 3/2018 345/211 |

FOREIGN PATENT DOCUMENTS

| | | | |
|---|---|---|---|
| KR | 20110042207 | A | 4/2011 |
| KR | 101158706 | B1 | 6/2012 |

* cited by examiner

ELECTROWETTING DISPLAY DEVICE HAVING IMPROVED APERTURE RATIO AND METHOD OF DRIVING THE SAME

CROSS-REFERENCE TO RELATED APPLICATION

This application claims the benefit of Korean Patent Application No. 10-2012-0131943, filed on Nov. 20, 2012, in the Korean Intellectual Property Office, the disclosure of which is incorporated herein in its entirety by reference.

BACKGROUND

1. Field

The present disclosure relates to electrowetting display devices and methods of driving the same.

2. Description of the Related Art

Changes in the shape of liquid droplet when voltage is applied to the liquid droplet under certain conditions are called electrowetting. By using such an electrowetting phenomenon, for example, an electrowetting lens that electrically changes the focal length or an electrowetting scanner that electrically changes the refraction angle are now being developed.

An electrowetting display device makes use of such an electrowetting phenomenon. The electrowetting display device includes pixels, each having a structure in which oil colored with red, green, blue or black is disposed on a hydrophobic insulation layer. In such an electrowetting display device, when voltage is applied to each pixel, as the hydrophobic insulation layer (e.g., an insulation layer that resists mixture with water) changes into a hydrophilic insulation layer (e.g., an insulation layer that is soluble with water), the oil gathers on one side.

When no voltage is applied to each pixel, the oil is uniformly spread on the hydrophobic insulation layer. If a white reflective plate is disposed on the rear surface of an electrowetting display device, a pixel is colored with white when a voltage is applied to produce the hydrophilic insulation layer that causes the oil to gather on one side. In contrast, if a white reflective plate is disposed on the rear surface of an electrowetting display device, a pixel is tinted with the color of the oil when no voltage is applied.

The electrowetting display device may be manufactured into a transmissive type using a backlight unit or a reflective type using external light. A reflective type electrowetting display device has excellent visibility in strong outdoor sunlight and less power consumption, and furthermore has an excellent reproduction of natural colors because to produce colors oil is colored using dye. Accordingly, such an electrowetting display device can be applied to bendable electronic paper.

SUMMARY

Provided is an electrowetting display device having an improved aperture ratio by preventing the backflow of non-polar liquid.

Provided is a method of driving an electrowetting display device to prevent the backflow of non-polar liquid.

Additional aspects will be set forth in part in the description which follows and, in part, will be apparent from the description, or may be learned by practice of the presented embodiments.

According to an example embodiment, an electrowetting display device includes: an electrowetting pixel cell including a polar liquid and a non-polar liquid disposed between a common electrode and a pixel electrode, the pixel electrode configured to receive a fixed voltage and the common electrode configured to receive a variable voltage that varies according to an image signal; and a driving circuit controlling an operation of the electrowetting pixel cell by, providing an image signal to the electrowetting pixel cell at a display interval where the electrowetting pixel cell displays an image, and providing a reset voltage to the electrowetting pixel cell at a reset interval, wherein an absolute value of a difference between the voltage applied to the pixel electrode and the reset voltage is greater than that of a difference between the voltage applied to the pixel electrode and the voltage applied to the common electrode.

The driving circuit may be configured to select one of different reset voltages at a reset interval according to an image to be displayed in a next frame and apply the selected reset voltage to the electrowetting pixel cell.

The electrowetting pixel cell may include: a rear substrate and a front substrate facing each other; the pixel electrode on the top surface of the rear substrate; a hydrophobic insulation layer on the pixel electrode; the non-polar liquid on the hydrophobic insulation layer; the common electrode on the bottom surface of the front substrate; and the polar liquid filled in a space between the front substrate and the rear substrate.

The front substrate and the rear substrate may be transparent substrates.

The front substrate may be a transparent substrate and the rear substrate may be a white color reflective plate.

The polar liquid may be a transparent liquid, and the non-polar liquid may be tinted with a predetermined color.

The driving circuit may include: a transistor; a capacitor having a first end that is electrically connected to a source of the transistor; a data line connected to a drain of the transistor to provide an image signal of an image to be displayed; a switch line connected to a gate of the transistor to provide a signal for switching an ON/OFF operation of the transistor; and a reset line connected to a second end of the capacitor to provide the reset voltage.

The source of the transistor may be electrically connected to the pixel electrode of the electrowetting pixel cell.

The driving circuit may be configured to sequentially switch the transistor into a first ON state, an OFF state, and a second ON state at the reset interval of the electrowetting pixel cell, and may be configured to apply the reset voltage to the capacitor through the reset line when the transistor is in an OFF state.

When the transistor is in the first ON state, the driving circuit may be configured to select one of a plurality of different voltages according to an image to be displayed in the next frame and provide the selected voltage to the electrowetting pixel cell through the data line.

The driving circuit may be configured to provide a first reset voltage through the reset line at the display interval, and provide a second reset voltage through the reset line at the reset interval, the first reset voltage being less than the second reset voltage.

The driving circuit may include: first and second transistors connected in series; a capacitor having a first end that is electrically connected to a source of the second transistor; a data line connected to a drain of the first transistor to provide an image signal of an image to be displayed; first and second switch lines connected to gates of the first and second transistors, respectively, to provide signals in order to switch ON/OFF operations of the first and second transistors; and a reset line connected to a second end of the capacitor to provide a reset voltage, wherein the source of the first transistor may be connected to the drain of the second transistor.

The source of the second transistor may be electrically connected to the pixel electrode of the electrowetting pixel cell.

The driving circuit may be configured to sequentially switch a first ON state, an OFF state, and a second ON state of the first transistor and continuously switch the second transistor into an ON state at the reset interval of the electrowetting pixel cell, and when the first transistor is in the OFF state, may be configured to apply the reset voltage to the capacitor through the reset line.

When the first transistor is in the first ON state, the driving circuit may be configured to select one of a plurality of different voltages according to an image to be displayed in the next frame and provide the selected voltage to the electrowetting pixel through the data line.

The driving circuit may be configured to provide a first reset voltage through the reset line at the display interval, and provide a second reset voltage through the reset line at a reset interval, the first reset voltage being less than the second reset voltage.

The driving circuit may include: first and second transistors connected in series; a capacitor having a first end that is electrically connected between the first transistor and the second transistor and having a second end that is grounded; a third transistor that is turned ON/OFF in opposition to the second transistor; a first switch line connected to a gate of the first transistor; a second switch line connected to gates of the second and third transistors; an inverter disposed at a gate of one of the second transistor and the third transistor; an offset line connected to a drain of the third transistor to provide the reset voltage; and a data line connected to a drain of the first transistor to provide an image signal of an image to be displayed.

A source of the first transistor and a drain of the second transistor may be electrically connected to each other, and sources of the second and third transistors may be electrically connected to the pixel electrode of the electrowetting pixel cell.

According to another aspect of the present invention, a method of driving an electrowetting display device includes: displaying an image by an electrowetting pixel cell by applying a fixed voltage to a common electrode of the electrowetting pixel cell and applying a variable voltage to a pixel electrode of the electrowetting pixel cell according to an image signal; and resetting the electrowetting pixel cell by applying a reset voltage to the pixel electrode, the reset voltage exceeding a voltage level applied to the common electrode of the electrowetting pixel cell, wherein an absolute value of a difference between the voltage applied to the pixel electrode and the reset voltage is greater than that of a difference between the voltage applied to the pixel electrode and the voltage applied to the common electrode.

The method may further include selecting one of different reset voltages at the reset interval according to an image to be displayed in a next frame and applying the selected reset voltage to the pixel electrode of the electrowetting pixel cell.

The displaying the image may display the image on the electrowetting display device which may include a driving circuit controlling an operation of the electrowetting pixel cell, wherein the driving circuit may include: a transistor; a capacitor having a first end that is electrically connected to a source of the transistor; a data line connected to a drain of the transistor to provide an image signal of an image to be displayed; a switch line connected to a gate of the transistor to provide a signal for switching an ON/OFF operation of the transistor; and a reset line connected to a second end of the capacitor to provide a reset voltage, wherein the source of the transistor may be electrically connected to the pixel electrode of the electrowetting pixel cell.

The resetting of the electrowetting pixel cell may include: sequentially switching the transistor into a first ON state, an OFF state, and a second ON state; and applying the reset voltage to the capacitor through the reset line when the transistor is in an OFF state.

The method may further include, when the transistor is in the first ON state, selecting one of a plurality of different voltages according to an image to be displayed in the next frame and providing the selected voltage to the electrowetting pixel cell through the data line.

The displaying of the image may include providing a first reset voltage through the reset line, and the resetting of electrowetting pixel cell may include providing a second reset voltage through the reset line, the first reset voltage being less than the second reset voltage.

The electrowetting display device may include a driving circuit controlling an operation of the electrowetting pixel cell, wherein the driving circuit may include: first and second transistors connected in series; a capacitor having a first end that is electrically connected to a source of the second transistor; a data line connected to a drain of the first transistor to provide an image signal of an image to be displayed; first and second switch lines connected to gates of the first and second transistors, respectively, to provide signals to switch ON/OFF operations of the first and second transistors; and a reset line connected to a second end of the capacitor to provide a reset voltage, wherein the source of the first transistor may be connected to the drain of the second transistor and the source of the second transistor may be electrically connected to the pixel electrode of the electrowetting pixel cell.

The resetting of the electrowetting pixel cell may include: sequentially switching a first ON state, an OFF state, and a second ON state of the first transistor; continuously switching the second transistor into an ON state; and when the first transistor is in an OFF state, applying the reset voltage to the capacitor through the reset line.

The device may further include, when the first transistor is in the first ON state, selecting one of a plurality of different voltages according to an image to be displayed in the next frame and providing the selected voltage to the electrowetting pixel cell through the data line.

The displaying of the image may include providing a first reset voltage through the reset line, and the resetting of the electrowetting pixel cell includes providing a second reset voltage through the reset line, the first reset voltage being less than the second reset voltage.

The electrowetting display device may include a driving circuit controlling an operation of the electrowetting pixel cell, wherein the driving circuit may include: first and second transistors connected in series; a capacitor having a first end that is electrically connected between the first transistor and the second transistor and having a second end that is grounded; a third transistor that is turned ON/OFF in opposition to the second transistor; a first switch line connected to a gate of the first transistor; a second switch line connected to gates of the second and third transistors; an inverter disposed at a gate of one of the second transistor and the third transistor; an offset line connected to a drain of the third transistor to provide a reset voltage; and a data line connected to a drain of the first transistor to provide an image signal of an image to be displayed.

The inverter may be inserted into the gate of the second transistor, wherein the displaying of the image may include applying a first voltage to the second switch line and the resetting of the electrowetting pixel cell may include providing a second voltage to the second switch line, the first voltage being less than the second voltage.

The inverter may be inserted into the gate of the third transistor, wherein the displaying of the image may include applying a first voltage to the second switch line and the resetting of the electrowetting pixel cell may include providing a second voltage to the second switch line, the first voltage being less than the second voltage.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
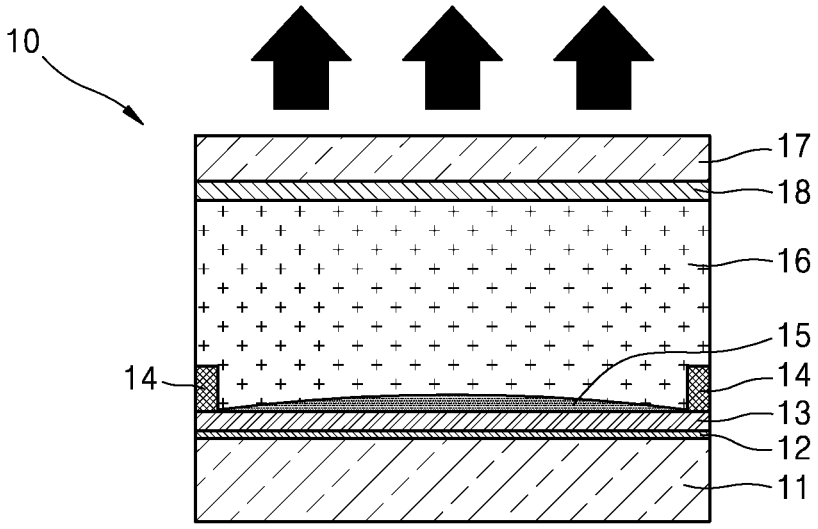
FIGS. 1 and 2 are cross-sectional views illustrating a structure and an operation of one electrowetting pixel cell of an electrowetting display device according to an example embodiment.

Hereinafter, an electrowetting display device and a method of driving the same are described in more detail with reference to the accompanying drawings. In the drawings, the thicknesses of layers and regions are exaggerated for clarity. Like reference numerals in the drawings denote like elements.

Detailed illustrative embodiments are disclosed herein. However, specific structural and functional details disclosed herein are merely representative for purposes of describing example embodiments. Example embodiments may be embodied in many alternate forms and should not be construed as limited to only those set forth herein.

It should be understood, however, that there is no intent to limit this disclosure to the particular example embodiments disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of this disclosure. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Various example embodiments of the present invention will now be described more fully with reference to the accompanying drawings in which some example embodiments of the invention are shown. In the drawings, the thicknesses of layers and regions are exaggerated for clarity. In this specification, when a portion of a layer, a film, a region, and a plate is referred to as being "on" another portion, it can be directly on the other portion, or intervening portions may also be present.

Figure 2:
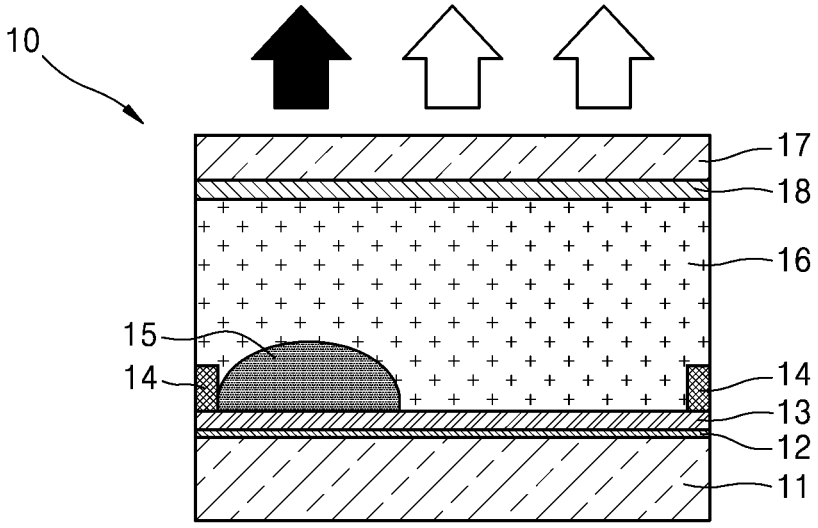

FIGS. 1 and 2 are cross-sectional views illustrating a structure and an operation of one electrowetting pixel cell of an electrowetting display device according to an example embodiment. For the sake of brevity, only one pixel cell among a plurality of electrowetting pixel cells in the electrowetting display device is shown.

Referring to FIGS. 1 and 2, each electrowetting pixel cell in a plurality of pixel cells 10 of the electrowetting display device include a rear substrate 11 and a front substrate 17 facing each other, a pixel electrode 12 on the upper surface of the rear substrate 11, a hydrophobic insulation layer 13 on the pixel electrode 12, a non-polar liquid 15 on the hydrophobic insulation layer 13, a vertical partition 14 vertically protruding on the rear substrate 11 to distinguish pixels, a common electrode 18 on the lower surface of the front substrate 17, and a polar liquid 16 filled in a space between the front substrate 17 and the rear substrate 11.

In a transmissive type electrowetting display device, both the rear substrate 11 and the front substrate 17 may be transparent. In a reflective type electrowetting display device, the front substrate 17 may be a transparent substrate and the rear substrate 11 may be a white reflective plate.

The common electrode 18 at the lower surface of the front substrate 17 is commonly connected to the plurality of pixel cells 10 of the electrowetting display device, and a fixed voltage is applied to the common electrode 18 constantly. The pixel electrode 12 may be separately disposed in each pixel cell 10, and a voltage applied to the pixel electrode 12 may be variable according to a desired color and grey level.

The non-polar liquid 15 is a liquid having no polarity such as oil, and for example, may be colored with a red, blue, or black dye. The non-polar liquid 15 is surrounded by the partition 14 in each electrowetting pixel cell 10, and is disposed on the hydrophobic insulation layer 13. The polar liquid 16 is a transparent liquid having polarity and may include de-ionized (DI) water, a liquid obtained by dissolving another polar substance in polar material in DI water, or ethylene glycol glycerin (EGG). The top surface of the partition 14 is spaced apart from the front substrate 17 so that the polar liquid 16 may be filled in the plurality of electrowetting pixel cells 10.

If the electrowetting pixel cell 10 is in an OFF state, having no potential difference between the pixel electrode 12 and the common electrode 18 (i.e. when the same voltage is applied to the pixel electrode 12 and the common electrode 18), the non-polar liquid 15 is uniformly distributed over the hydrophobic insulation layer 13 and thus covers the entire hydrophobic insulation layer 13. Therefore, the electrowetting pixel cell 10 is tinted with the same color as the non-polar liquid 15. For example, a voltage applied to the common electrode 18 is fixed with +15V and a voltage of about +15V is applied to the pixel electrode 12 during the OFF state.

In contrast, a potential difference between the pixel electrode 12 and the common electrode 18 occurs by changing a voltage applied to the pixel electrode 12 during an ON state For example, while the voltage applied to the common electrode 18 is fixed with +15V, a voltage of about −15V may be applied to the pixel electrode 12 during an ON state. When the electrowetting display device is in the ON state, due to an electric field between the two electrodes 12 and 18, the surface of the hydrophobic insulation layer 13 becomes hydrophilic.

As shown in FIG. 2, when the electrowetting display device is in the ON state and the hydrophobic insulation layer 13 becomes hydrophilic, the non-polar liquid 15 is pushed to a corner of the hydrophobic insulation layer 13, and the polar liquid 16 is distributed over the surface of the hydrophobic insulation layer 13 that changed into hydrophilic. Accordingly, the electrowetting pixel cell 10 transmits or reflects light. For example, when the rear substrate 11 is a transparent substrate and a backlight unit (not shown) is disposed below the rear substrate 11, the light emitted from the backlight unit penetrates the electrowetting pixel cell 10. Alternatively, if the rear substrate 11 is a white reflective plate, it reflects external light and the electrowetting pixel cell 10 is tinted with white color. Here, according to the intensity of a voltage applied to the pixel electrode 12, the degree of the non-polar 15 being pushed away may vary.

However, when a potential difference between the pixel electrode 12 and the common electrode 18 is continuously maintained in the electrowetting pixel cell 10 of the electrowetting display device, for example, when the electrowetting pixel cell 10 displays white color continuously, the non-polar liquid 15 pushed on one side due to the hydrophobic insulation layer that changed into hydrophilic spreads onto the hydrophobic insulation layer 13 again due to a backflow phenomenon of the non-polar liquid 15.

The backflow phenomenon occurs when ions penetrate into the polar liquid 16 due to the electric field between the pixel electrode 12 and the common electrode 18, resulting in the non-polar liquid 15 being charged. When the non-polar liquid 15 is charged, electric force acts between the pixel electrode 12 and the non-polar liquid 15, so that the non-polar liquid 15 covers the surface of the hydrophobic insulation layer 13, resulting in a reduction of the reflectivity or transparency of the electrowetting pixel cell 10. For example, when a voltage applied to the common voltage 18 is fixed with +15V and a voltage of −15V is continuously applied to the pixel electrode 12.

Figure 3:
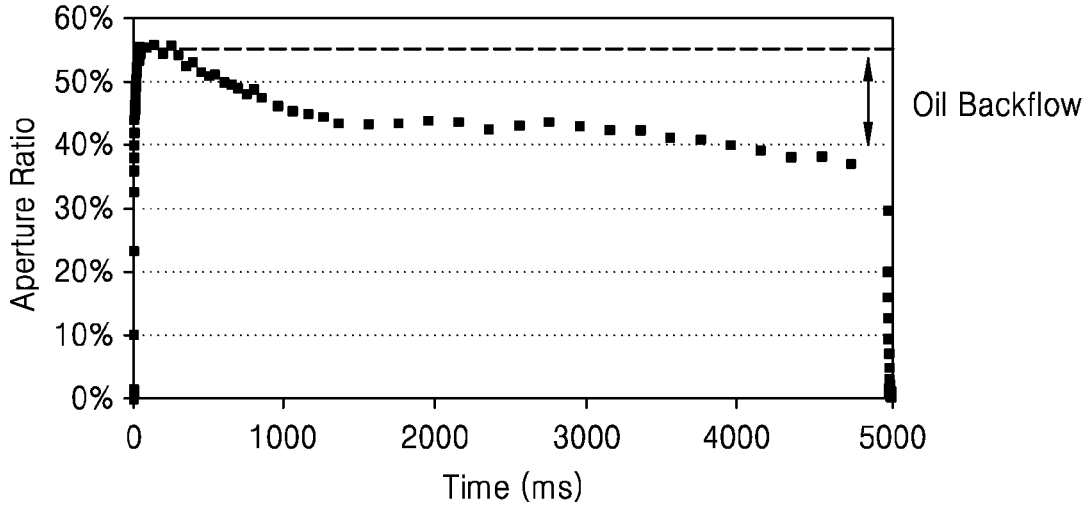
FIG. 3 is a graph illustrating the deterioration of a reflectivity of an electrowetting pixel cell due to the backflow of a non-polar liquid.

FIG. 3 is a graph confirming that the reflectivity of the electrowetting pixel cell 10 is gradually reduced as time elapses due to the backflow phenomenon. Especially, when the electrowetting display device has a reflective type, since the reflectivity of the electrowetting pixel cell 10 is a main factor to determine the quality of a display device, the backflow phenomenon needs to be suppressed.

In order to suppress the backflow phenomenon, the non-polar liquid 15 may be periodically discharged by periodically applying the same voltage to the pixel electrode 12 and the common electrode 18. If there is no electric field between the pixel electrode 12 and the common electrode 18, as ions penetrating the non-polar liquid 15 exit naturally through the polar liquid 16, the non-polar liquid 15 may be discharged.

However, an amount of time necessary to naturally discharge the non-polar liquid 15 using the periodic discharging may increase a display time of the white color by the electrowetting pixel cell 10 beyond a desired period. Therefore, the periodic discharging method may be an insufficient method to prevent the backflow phenomenon.

Thus, according to one or more example embodiment, the discharge of the polar liquid 16 may be accelerated by periodically applying a reset voltage, which is greater than the fixed voltage applied to the common electrode 19, to the pixel electrode 12 in a method known as inversion reset.

Figure 4:
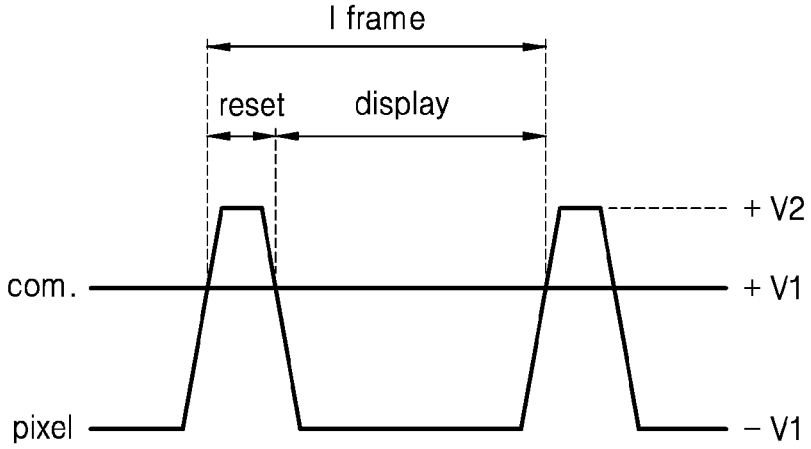
FIG. 4 is a timing diagram when a voltage is applied to the common electrode and the pixel electrode of an electrowetting pixel cell in order to prevent the backflow of a non-polar liquid.

FIG. 4 is a timing diagram illustrating an example of a voltage applied to the common electrode 18 and the pixel electrode 12 of the electrowetting pixel cell 10 in an electrowetting display device in order to prevent the backflow of the non-polar liquid 15 according to an example embodiment.

Referring to FIG. 4, a voltage of +V1 may be maintained at the common electrode 18 all the time, and a reset voltage of +V2 greater than +V1 may be applied to the pixel electrode 12 before the image of one frame is displayed. After that, although it is shown in FIG. 4 that a voltage of −V1 is continuously applied to the pixel electrode 12, any voltage from +V1 to −V1 may be applied to the pixel electrode 12 according to the gray level of an image to be displayed. For example, +V1 may be about 15V and +V2 may be about 30V. In the sense that a voltage applied to the common electrode 18 is greater than a reset voltage.

Although it is shown in FIG. 4 that a reset voltage is applied at the start of one frame, it may be applied after the end of one frame. Accordingly by using the inversion reset method of one or more example embodiment, the backflow may be effectively suppressed through the forced discharge of the polar liquid 16, and the aperture ratio of the electrowetting pixel cell 10 may be further improved by gathering the polar liquid 16 in a narrower zone.

Figure 5A:
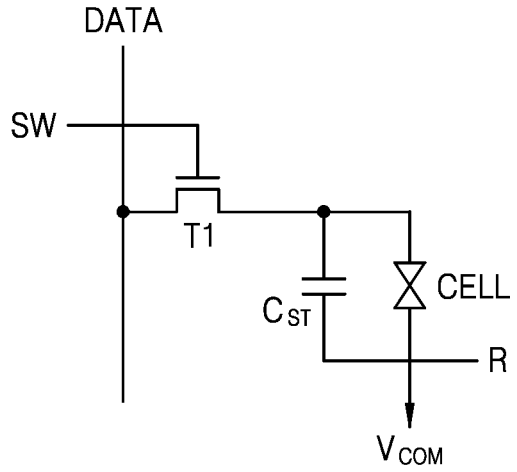
FIG. 5A is a circuit diagram illustrating an example driving circuit of an electrowetting display device according to an example embodiment to implement the operation shown in FIG. 4.

FIG. 5A is a circuit diagram illustrating an exemplary driving circuit of an electrowetting display device according to an embodiment to implement the operation shown in FIG. 4.

Referring to FIG. 5A, the driving circuit may include a transistor T1 and a capacitor $C_{ST}$ electrically connected to the source of the transistor T1. And, the pixel electrode 12 of the electrowetting pixel cell 10 in the electrowetting display device may be electrically connected to the source of the transistor T1. A data line DATA providing an image signal of an image to be displayed may be electrically connected to the drain of the transistor T1, and a switch line SW providing a signal for switching an ON/OFF operation of the transistor T1 may be electrically connected to the gate of the transistor T1. Moreover, a reset line R may be electrically connected to one end of the capacitor $C_{ST}$. Such a driving circuit may be disposed in each electrowetting pixel cell 10.

Figure 5B:
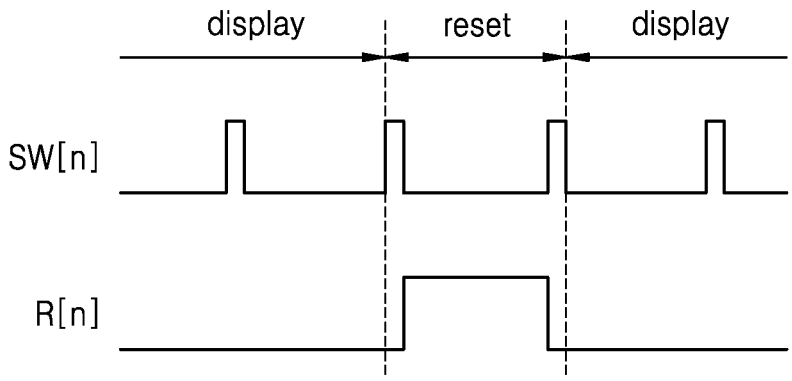
FIG. 5B is a timing diagram illustrating an operation of the circuit diagram of FIG. 5A.

FIG. 5B is a timing diagram illustrating an operation of the driving circuit of FIG. 5A.

Referring to FIG. 5B, during a display operation in which the electrowetting display device displays the image of one frame, an image signal is provided to each electrowetting pixel cell 10 by sequentially scanning pixel rows one by one and applying a low voltage to the reset line R. For example, when an image signal is provided to the electrowetting pixel cells 10 in the nth pixel row, a high voltage is applied to the gate of the transistor T1 through the switch line SW of the nth pixel row. Then, as the transistor T1 in the nth pixel row switches to the ON state, an image signal may be stored in the capacitor $C_{ST}$ through the data line DATA. The image signal may be expressed with a voltage of +V1 to −V1 applied to the pixel electrode 12, for example. Thereafter, when a low voltage is applied to the gate of the transistor T1, the transistor T1 switches to the OFF state, and until one frame is ended, an image signal stored in the capacitor $C_{ST}$ is provided to the electrowetting pixel cell 10.

In order to prevent the backflow phenomenon, an reset operation may be performed at the end of the frame before another frame starts.

As shown in FIG. 5B, during the reset operation a high voltage may be applied to the gate of the transistor T1 through the switch line SW. This high voltage applied may switch the transistor T1 into an ON state and a voltage identical to that applied to the common electrode 18 may be provided to the data line DATA. For example, when a voltage of +V1 is provided through the data line DATA, a potential difference between both ends of the capacitor $C_{ST}$ becomes +V1. After that, the transistor T1 switches into an OFF state again and a high voltage is applied to the reset line R. Then, a voltage applied to the pixel electrode 12 connected to the capacitor $C_{ST}$ is increased due to a bootstrap action. Accordingly, a voltage greater than that of the common electrode 18 is applied to the pixel electrode 12. Therefore, the non-polar liquid 15 in the electrowetting pixel cell 10 may be discharged. For example, when a voltage of +V1 is applied to the reset line R, a voltage of +V1*2 may be applied to the pixel electrode 12. Thereafter, a high voltage is applied to the gate of the transistor T1 through the switch line SW in order to switch the transistor T1 into an ON state, then the capacitor $C_{ST}$ may be initialized for the display of the next frame.

The driving circuit according to this example embodiment uses the bootstrap action to perform the inversion reset operation by applying a high voltage to the pixel electrode 12 using existing data and gate voltages. Thus, according to this example embodiment, there is no need to change the design of an existing voltage supplying circuit in order to obtain a high voltage for an inversion reset operation.

However, when the inversion reset is repeated, the color characteristic of black color (or, another color tinted in the non-polar liquid 15) expressed in the electrowetting pixel cell 10 may be deteriorated when black color is expressed. Accordingly, inversion reset may be selectively performed according to an image to be expressed in each electrowetting pixel cell 10. For example, in a first one of the electrowetting pixel cells 10 expressing a white color image in the next frame, an inversion reset operation is performed. In a second one of the electrowetting pixel cells 10 expressing a black color image in the next frame, an existing voltage applied to the pixel electrode 12 may be maintained as it is, a voltage of 0V may be applied to the pixel electrode 12, or a typical reset operation applying the same voltage as the common electrode 18 to the pixel electrode 12 may be performed. That is, according to an image to be displayed in the next frame, one of at least two different reset voltages is selected to be applied to the electrowetting pixel cell 10, or a reset operation may not be performed.

For example, referring to FIG. 5B, as described above, a high voltage of +V1 may be applied to the electrowetting pixel cell 10 to which inversion reset is to be applied, through the data line DATA in a reset interval. Then, when a high voltage is applied to the reset line R, inversion reset is performed. However, a voltage of 0V may be applied to the electrowetting pixel cell 10 to which a typical reset is to be applied, through the data line DATA in a reset interval. Then, when a high voltage is applied to the reset line R, the same voltage is applied to the common electrode 18 and the pixel electrode 12 in order to perform a typical reset using the periodic discharging method. Additionally, when a voltage of −V1 is applied through the data line DATA in a reset interval, a reset operation may not be performed.

Figure 6A:
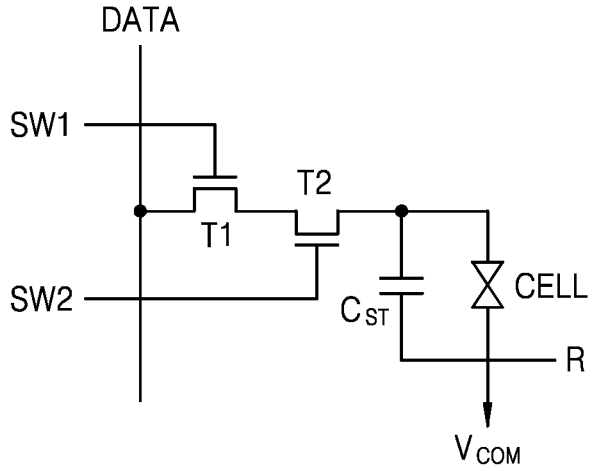
FIG. 6A is a circuit diagram illustrating an example driving circuit of an electrowetting display device according to another example embodiment to implement the operation shown in FIG. 4.

FIG. 6A is a circuit diagram illustrating an example driving circuit of an electrowetting display device according to another example embodiment to implement the reset operation shown in FIG. 4.

Referring to FIG. 6A, the driving circuit may include a first transistor T1 and a second transistor T2 connected in series and a capacitor $C_{ST}$ electrically connected to the source of the second transistor T2. For example, the source of the first transistor T1 may be electrically connected to the drain of the second transistor T2. And, the pixel electrode 12 of the electrowetting pixel cell 10 in the electrowetting display device may be electrically connected to the source of the second transistor T2. A data line DATA providing an image signal of an image to be displayed may be electrically connected to the drain of the first transistor T1, and first and second switch lines SW1 and SW2 may be electrically connected to the gates of the first and second transistors T1 and T2, respectively. Moreover, a reset line R may be electrically connected to one end of the capacitor $C_{ST}$.

Figure 6B:
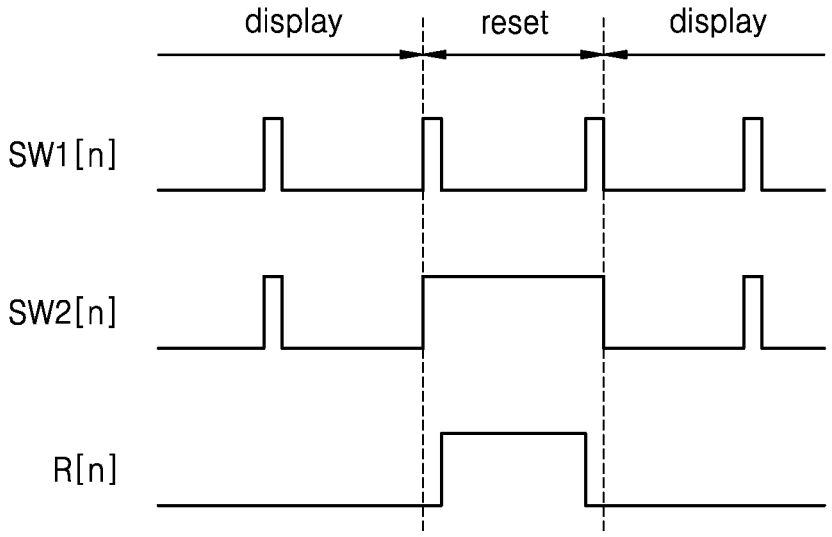
FIG. 6B is a timing diagram illustrating an operation of the circuit diagram of FIG. 6A.

FIG. 6B is a timing diagram illustrating an operation of the driving circuit of FIG. 6A.

Referring to FIG. 6B, the same signal may be simultaneously applied to the first and second switch lines SW1 and SW2 at a display interval to display an image. Accordingly, the first and second transistors T1 and T2 are simultaneously turned ON/OFF. When all the first and second transistors T1 and T2 are turned on, an image signal may be stored in the capacitor $C_{ST}$ through the data line DATA.

Moreover, like FIG. 5B, during a reset interval, the first transistor T1 is turned on at a reset interval right before and after a voltage is applied to the reset line R and is turned off only when a voltage is applied to the reset line R, but the second transistor T2 may maintain an ON state. For example, as all the first and second transistors T1 and T2 are turned on right before a high voltage is applied to the reset line R, a voltage may be applied to the capacitor $C_{ST}$ through the data line DATA. After that, only the first transistor T1 switches into an OFF state and the second transistor T2 maintains an ON state. Then, a high voltage is applied to the reset line R. As described above, according to a voltage provided through the data line DATA, an inversion reset operation may be performed, a typical reset operation may be performed, or a reset operation may not be performed. After that, by switching the first transistor T1 into an ON state again, all the first and second transistors T1 and T2 may be turned on, and the capacitor $C_{ST}$ may be initialized for the display of the next frame.

In the case of the driving circuit of FIG. 6A using the two transistors T1 and T2, the driving circuit may operate as a double-gate at a display interval in order to reduce current leakage, and since a high voltage is distributed to the two transistors T1 and T2 at a reset interval to perform an inversion reset operation, stress applied on each of the transistors T1 and T2 may be effectively reduced and the deterioration of the transistors T1 and T2 may be prevented.

Figure 7A:
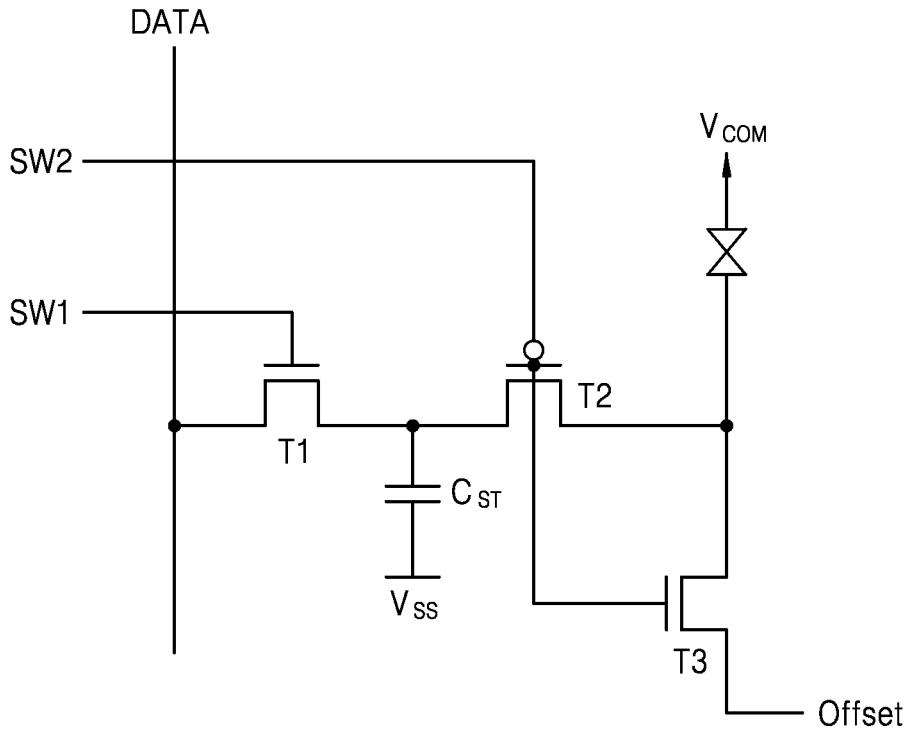
FIG. 7A is a circuit diagram illustrating an example driving circuit of an electrowetting display device according to another example embodiment to implement the operation shown in FIG. 4.

FIG. 7A is a circuit diagram illustrating an example driving circuit of an electrowetting display device according to another example embodiment to implement the operation shown in FIG. 4.

Referring to FIG. 7A, the driving circuit may include a first transistor T1 and a second transistor T2 connected in series, a capacitor $C_{ST}$ having one end electrically connected between the first transistor T1 and the second transistor T2 and the other end connected to ground, and a third transistor T3 turned ON/OFF in contrast to the second transistor T2 and connected to the pixel electrode 12 of the electrowetting pixel cell 10 of the electrowetting display device in addition to the second transistor T2. For example, the source of the first transistor T1 may be electrically connected to the drain of the second transistor T2. And, the sources of the second and third transistors T2 and T3 may be electrically connected to the pixel electrode 12 of the electrowetting pixel cell 10.

A data line DATA providing an image signal of an image to be displayed may be electrically connected to the drain of the first transistor T1, and the first switch line SW1 may be electrically connected to the gate. Additionally, the second switch line SW2 may be connected to the gates of the second transistor and the third transistor T3. Herein, one of the second transistor T2 and the third transistor T3 may include an inverter, so that the second transistor T2 and the third transistor T3 are turned ON/OFF in opposition to each other. For example, the second switch line SW2 may be connected to the gate of the second transistor through the inverter and may be directly connected to the gate of the third transistor T3. Also, an offset line Offset for reset voltage may be connected to the drain of the third transistor T3.

Figure 7B:
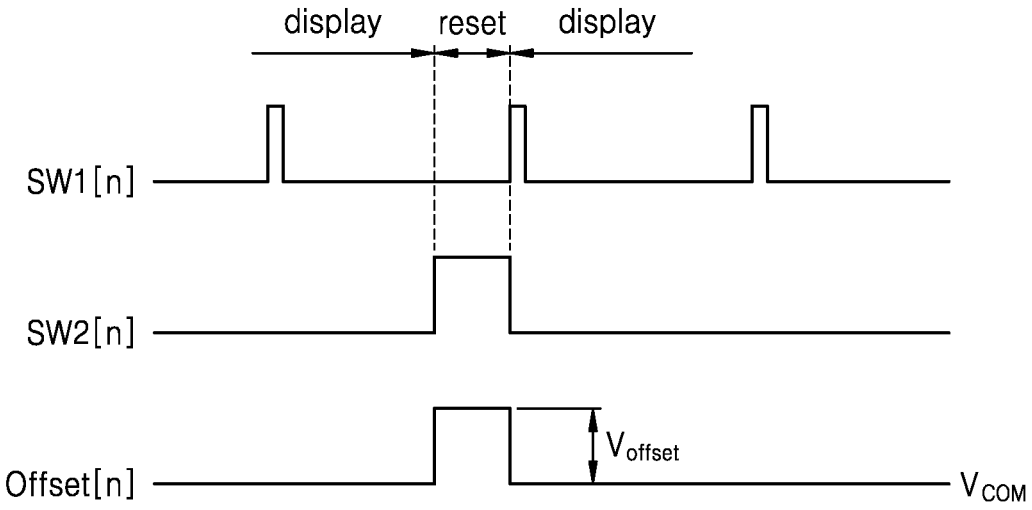
FIG. 7B is a timing diagram illustrating an operation of the circuit diagram of FIG. 7A.

FIG. 7B is a timing diagram illustrating an operation of the circuit diagram of FIG. 7A.

Referring to FIG. 7B, while the electrowetting display device displays the image of one frame, an image signal is provided to each electrowetting pixel cell 10 by sequentially scanning pixel rows one by one. For example, when an image signal is provided to the electrowetting pixel cells 10 in the nth pixel row, a high voltage is applied through the switch line SW of the nth pixel row and a low voltage is applied to the second switch line SW2. Then, the first transistor T1 and the second transistor T2 in the nth pixel row are turned on, and the third transistor T3 is turned off. Since the first transistor T1 and the second transistor T2 are turned on, an image signal of the data line DATA is provided to the electrowetting pixel cell 10 through the first transistor T1 and the second transistor T2. At this point, an image signal may be stored in the capacitor $C_{ST}$. On the contrary, since the third transistor T3 is turned off, a reset voltage of the offset line Offset is not provided to the electrowetting pixel cell 10.

Once an image signal is completely provided in the nth pixel row, a low voltage is applied to the first switch line SW1 and the second switch line SW2 of the nth pixel row. Then, a high voltage is applied to the first switch line SW1 of the (n+1)th pixel row. Then, the first transistor T1 and the third transistor T3 in the nth pixel row are in an OFF state and the second transistor T2 is in an ON state. In this case, since an image signal stored in the capacitor $C_{ST}$ is provided to the electrowetting pixel cell 10 through the second transistor T2, it is provided to the electrowetting pixel cell 10 until one frame ends.

In order to prevent the backflow phenomenon before another frame starts after the end of one frame, a reset operation may be performed. For a reset operation, a low voltage is applied to the first switch line SW1 and a high voltage is applied to the second switch line SW2. Then, the first transistor T1 and the second transistor T2 are turned off, and the third transistor T3 is turned on. Accordingly, an image signal is not provided to the electrowetting pixel cell 10, and a reset voltage of the offset line Offset may be provided to the pixel electrode 12 of the electrowetting pixel cell 10. For example, a reset voltage Voffset higher than a voltage applied to the common electrode 18 may be provided to the pixel electrode 12 of the electrowetting pixel cell 10 through the third transistor T3.

As shown in FIG. 7B, the reset voltage Voffset may be applied to the offset line Offset only at a reset interval, and a voltage Vcom of the common electrode 18 may be applied at a display interval.

It is described in FIGS. 7A and 7B that an inverter is connected to the gate of the second transistor T2. In this case, as described above, a high voltage is sequentially applied to the first switch line SW1 in a plurality of pixel rows at a display interval, and a low voltage is always applied to the second switch line SW2 at a display interval. However, an inverter may be connected to the gate of the third transistor T3. In this case, a signal applied to the second switch line SW2 may be opposite to that of FIG. 7B. For example, a high voltage is applied to the second switch line SW2 at a display interval and a low voltage is applied at a reset interval.

Until now, it is described that a fixed high voltage (for example, +15V) is applied to the common electrode 18 of the electrowetting pixel cell 10, and a variable low voltage (for example, +15 to −15V) is applied to the pixel electrode 12. As described above, a reset voltage at this point is higher than a voltage applied to the common electrode 18. However, according to example embodiments, a fixed low voltage (for example, −15V) may be applied to the common electrode 18 of the electrowetting pixel cell 10, and a variable high voltage (for example, −15V~+15V) may be applied to the pixel electrode 12. A reset voltage in this case is lower than a voltage applied to the common electrode 18. Additionally, a fixed voltage of 0V may be applied to the common electrode 18, and a variable voltage of 0V~−30V may be applied to the pixel electrode 12. In this case, the reset voltage may be higher than 0V. According to another example embodiment, a fixed voltage of 0V may be applied to the common electrode 18, and a variable voltage of 0V~+30V may be applied to the pixel electrode 12. In this case, the reset voltage may be lower than 0V. In any case, when the same voltage is applied to the pixel electrode 12 and the common electrode 18, the electrowetting pixel cell 10 displays a black color image and as a voltage difference between the pixel electrode 12 and the common electrode 18 becomes greater, the electrowetting pixel cell 10 displays a white color image. Also, the reset voltage may be set to exceed a voltage level applied to the common electrode 18, from a voltage level applied to the pixel electrode 12. That is, the absolute value of the difference between a voltage applied to the pixel electrode 12 and a reset voltage may be greater than that of the difference between a voltage applied the pixel electrode 12 and a voltage applied to the common electrode 18. Additionally, the absolute value of the reset voltage may be greater than that of the voltage applied to the common electrode 18.

Example embodiments for an electrowetting display device having an improved aperture ratio and a method of driving the same are described and shown in the accompanying drawing, in order to help the understanding of the present invention. However, such example embodiments are just examples and the embodiments are not limited thereto. Also, embodiments are not limited to the shown and described contents. This is because various modifications are possible for one of ordinary skill in the art.

It should be understood that the example embodiments described therein should be considered in a descriptive sense only and not for purposes of limitation. Descriptions of features or aspects within each embodiment should typically be considered as available for other similar features or aspects in other embodiments.

What is claimed is:

1. An electrowetting display device comprising:

an electrowetting pixel cell including a polar liquid and a non-polar liquid disposed between a common electrode and a pixel electrode, the pixel electrode configured to receive a fixed voltage and the common electrode configured to receive a variable voltage that varies according to an image signal; and a driving circuit configured to control an operation of the electrowetting pixel cell by, providing an image signal to the electrowetting pixel cell at a display interval where the electrowetting pixel cell displays an image, and providing a reset voltage to the electrowetting pixel cell at a reset interval, wherein an absolute value of a difference between the voltage applied to the pixel electrode and the reset voltage is greater than an absolute value of a difference between the voltage applied to the pixel electrode and the voltage applied to the common electrode in every reset operation, and the driving circuit is configured to select one of different reset voltages at the reset interval according to an image to be displayed in a next frame, and to apply the selected reset voltage to the electrowetting pixel cell.

2. The device of claim 1, wherein the driving circuit comprises:

a transistor;

a capacitor having a first end that is electrically connected to a source of the transistor;

a data line connected to a drain of the transistor, the data line configured to provide an image signal of an image to be displayed;

a switch line connected to a gate of the transistor, the switch line configured to provide a signal for switching an ON/OFF operation of the transistor; and a reset line connected to a second end of the capacitor, the reset line configured to provide the reset voltage, wherein the source of the transistor is electrically connected to the pixel electrode of the electrowetting pixel cell.

3. The device of claim 2, wherein the driving circuit is configured to sequentially switch the transistor into a first ON state, an OFF state, and a second ON state at the reset interval of the electrowetting pixel cell, and the driving circuit is further configured to apply the reset voltage to the capacitor through the reset line when the transistor is in an OFF state, and to select one of a plurality of different voltages according to an image to be displayed in a next frame and provide the selected voltage to the electrowetting pixel cell through the data line when the transistor is in the first ON state.

4. The device of claim 2, wherein the driving circuit is configured to provide a first reset voltage through the reset line at a display interval, and provide a second reset voltage through the reset line at the reset interval, the first reset voltage being less than the second reset voltage.

5. The device of claim 1, wherein the driving circuit comprises:

first and second transistors connected in series;

a capacitor having a first end that is electrically connected to a source of the second transistor;

a data line connected to a drain of the first transistor, the data line configured to provide an image signal of an image to be displayed;

first and second switch lines connected to gates of the first and second transistors, respectively, the first and second switch lines configured to provide signals in order to switch ON/OFF operations of the first and second transistors; and a reset line connected to a second end of the capacitor, the reset line configured to provide the reset voltage, wherein the source of the first transistor is connected to the drain of the second transistor and the source of the second transistor is electrically connected to the pixel electrode of the electrowetting pixel cell.

6. The device of claim 5, wherein the driving circuit is configured to, sequentially switch a first ON state, an OFF state, and a second ON state of the first transistor, switch the second transistor into an ON state at the reset interval of the electrowetting pixel cell, when the first transistor is in the OFF state, apply the reset voltage to the capacitor through the reset line, and when the first transistor is in the first ON state, the driving circuit is configured to select one of a plurality of different voltages according to an image to be displayed in a next frame and provide the selected voltage to the electrowetting pixel cell through the data line.

7. The device of claim 5, wherein the driving circuit is configured to provide a first reset voltage to the electrowetting pixel cell through a reset line at a display interval, and provide to the electrowetting pixel cell a second reset voltage through a reset line at a reset interval, the first reset voltage being less than the second reset voltage.

8. An electrowetting display device comprising:

an electrowetting pixel cell including a polar liquid and a non-polar liquid disposed between a common electrode and a pixel electrode, the pixel electrode configured to receive a fixed voltage and the common electrode configured to receive a variable voltage that varies according to an image signal; and a driving circuit configured to control an operation of the electrowetting pixel cell, the driving circuit including, first and second transistors connected in series, a capacitor having a first end that is electrically connected between the first transistor and the second transistor and a second end that is grounded, a third transistor, the third transistor configured to turn ON/OFF in opposition to the second transistor, a first switch line connected to a gate of the first transistor, a second switch line connected to gates of the second and third transistors, an inverter disposed at a gate of one of the second transistor and the third transistor, an offset line connected to a drain of the third transistor, the offset line configured to provide the reset voltage, and a data line connected to a drain of the first transistor, the data line configured to provide an image signal of an image to be displayed, wherein a source of the first transistor and a drain of the second transistor are electrically connected to each other, and sources of the second and third transistors are electrically connected to the pixel electrode of the electrowetting pixel cell.

9. A method of driving an electrowetting display device, the method comprising:

displaying an image by an electrowetting pixel cell by applying a fixed voltage to a common electrode of the electrowetting pixel cell and applying a variable voltage to a pixel electrode of the electrowetting pixel cell according to an image signal; and resetting the electrowetting pixel cell by applying a reset voltage to the pixel electrode of the electrowetting pixel cell, the reset voltage exceeding a voltage level applied to the common electrode of the electrowetting pixel cell, wherein an absolute value of a difference between the voltage applied to the pixel electrode and the reset voltage is greater than an absolute value of a difference between the voltage applied to the pixel electrode and the voltage applied to the common electrode in every reset operation, and the resetting the electrowetting pixel cell includes selecting one of different reset voltages at a reset interval according to an image to be displayed in a next frame, and applying the selected reset voltage to the pixel electrode of the electrowetting pixel cell.

10. The method of claim 9, wherein the displaying the image displays the image on the electrowetting display device and the electrowetting display device includes a driving circuit controlling an operation of the electrowetting pixel cell, the driving circuit including, a transistor;

a capacitor having a first end that is electrically connected to a source of the transistor;

a data line connected to a drain of the transistor, the data line configured to provide an image signal of an image to be displayed;

a switch line connected to a gate of the transistor, the switch line configured to provide a signal for switching an ON/OFF operation of the transistor; and a reset line connected to a second end of the capacitor, the reset line configured to provide the reset voltage, wherein the source of the transistor is electrically connected to the pixel electrode of the electrowetting pixel cell.

11. The method of claim 10, wherein the resetting of the electrowetting pixel cell comprises:

sequentially switching the transistor into a first ON state, an OFF state, and a second ON state;

applying the reset voltage to the capacitor through the reset line when the transistor is in an OFF state; and selecting one of a plurality of different voltages according to an image to be displayed in a next frame and providing the selected voltage to the electrowetting pixel cell through the data line when the transistor is in the first ON state.

12. The method of claim 10, wherein the displaying of the image includes providing a first reset voltage through the reset line, and the resetting of electrowetting pixel cell includes providing a second reset voltage through the reset line, the first reset voltage being less than the second reset voltage.

13. The method of claim 9, wherein the displaying the image displays the image on the electrowetting display device and the electrowetting display device includes a driving circuit controlling an operation of the electrowetting pixel cell, the driving circuit including:

first and second transistors connected in series;

a capacitor having a first end that is electrically connected to a source of the second transistor;

a data line connected to a drain of the first transistor, the data line configured to provide an image signal of an image to be displayed;

first and second switch lines connected to gates of the first and second transistors, respectively, the first and second switch lines configured to provide signals to switch ON/OFF operations of the first and second transistors; and a reset line connected to a second end of the capacitor, the reset line configured to provide the reset voltage, wherein the source of the first transistor is connected to the drain of the second transistor and the source of the second transistor is electrically connected to the pixel electrode of the electrowetting pixel cell.

14. The method of claim 13, wherein the resetting of the electrowetting pixel cell comprises:

sequentially switching a first ON state, an OFF state, and a second ON state of the first transistor;

switching the second transistor into an ON state;

when the first transistor is in the OFF state, applying the reset voltage to the capacitor through the reset line; and when the first transistor is in the first ON state, selecting one of a plurality of different voltages according to an image to be displayed in the next frame and providing the selected voltage to the electrowetting pixel cell through the data line.

15. The method of claim 9, wherein the displaying of the image includes providing a first reset voltage to the electrowetting pixel cell through the reset line, and the resetting of the electrowetting pixel cell includes providing a second reset voltage through the reset line, the first reset voltage being less than the second reset voltage.

16. A method of driving an electrowetting display device, the method comprising:

displaying an image by an electrowetting pixel cell by applying a fixed voltage to a common electrode of the electrowetting pixel cell and applying a variable voltage to a pixel electrode of the electrowetting pixel cell according to an image signal; and resetting the electrowetting pixel cell by applying a reset voltage to the pixel electrode of the electrowetting pixel cell, the reset voltage exceeding a voltage level applied to the common electrode of the electrowetting pixel cell, wherein an absolute value of a difference between the voltage applied to the pixel electrode and the reset voltage is greater than an absolute value of a difference between the voltage applied to the pixel electrode and the voltage applied to the common electrode, and wherein the electrowetting display device includes a driving circuit configured to control an operation of the electrowetting pixel cell, the driving circuit including, first and second transistors connected in series, a capacitor having a first end that is electrically connected between the first transistor and the second transistor and a second end that is grounded, a third transistor, the third transistor configured to turn ON/OFF in opposition to the second transistor, a first switch line connected to a gate of the first transistor, a second switch line connected to gates of the second and third transistors, an inverter disposed at a gate of one of the second transistor and the third transistor, an offset line connected to a drain of the third transistor, the offset line configured to provide the reset voltage, and a data line connected to a drain of the first transistor, the data line configured to provide an image signal of an image to be displayed.

17. The method of claim 16, wherein the inverter is disposed at the gate of the second transistor, and the displaying of the image includes applying a first voltage to the second switch line and the resetting of the electrowetting pixel cell includes providing a second voltage to the second switch line, the first voltage being less than the second voltage.

18. The method of claim 16, wherein the inverter is disposed at the gate of the third transistor, and the displaying of the image includes applying a first voltage to the second switch line and the resetting of the electrowetting pixel cell includes providing a second voltage to the second switch line, the first voltage being greater than the second voltage.

* * * * *